US009700168B1

(12) United States Patent
Evans

(10) Patent No.: US 9,700,168 B1
(45) Date of Patent: Jul. 11, 2017

(54) PACKAGE RECEPTACLE SYSTEMS

(71) Applicant: Dion Evans, Sherman, TX (US)

(72) Inventor: Dion Evans, Sherman, TX (US)

( * ) Notice: Subject to any disclaimer, the term of this patent is extended or adjusted under 35 U.S.C. 154(b) by 0 days.

(21) Appl. No.: 15/174,912

(22) Filed: Jun. 6, 2016

Related U.S. Application Data

(60) Provisional application No. 62/191,676, filed on Jul. 13, 2015.

(51) Int. Cl.
*A47G 29/14* (2006.01)
*A47G 29/20* (2006.01)
*A47G 29/30* (2006.01)

(52) U.S. Cl.
CPC ..... *A47G 29/141* (2013.01); *A47G 29/20* (2013.01); *A47G 29/30* (2013.01); *A47G 2029/145* (2013.01); *A47G 2029/147* (2013.01)

(58) Field of Classification Search
CPC ..... A47G 29/141; A47G 29/20; A47G 29/30; A47G 2029/145; A47G 2029/146; A47G 2029/147; A47G 29/124; A47B 43/00; B65D 11/18; B65D 11/1853; B65D 9/12; B65D 7/26
USPC ..... 232/17, 19, 38, 45, 24, 25, 34; 312/258, 312/262; 220/4.29; 340/569, 5.73
See application file for complete search history.

(56) References Cited

U.S. PATENT DOCUMENTS 889,741 A * 6/1908 Additon ..... A47B 43/00 312/258
933,210 A * 9/1909 Ullom ..... B65D 9/14 217/14
2,934,389 A * 4/1960 Krey ..... A47B 43/02 220/6
3,294,464 A * 12/1966 Lew ..... A47B 43/02 312/258
3,606,509 A * 9/1971 Bennett ..... A47B 83/045 312/241
5,794,844 A * 8/1998 Jenkins ..... A47G 29/1201 232/25
5,820,018 A * 10/1998 Stacy ..... A47G 29/16 211/10
5,979,750 A * 11/1999 Kindell ..... A47G 29/141 232/1 R
6,450,599 B1 * 9/2002 Mamuyac ..... A47B 46/005 312/258
6,715,669 B2 * 4/2004 Hara ..... G07C 9/00103 232/19

(Continued)

*Primary Examiner* — William Miller
(74) *Attorney, Agent, or Firm* — Integrity Patent Group, PLC; Edwin Wold

(57) ABSTRACT

A package receptacle system including a package receptacle assembly. The package receptacle assembly may include a door-unit, a locking-mechanism, a top-unit, a rear-wall, a floor-unit, and two foldable-side-walls in functional and structural combination. The package receptacle assembly is structured and arranged to provide a user with a device useful for placing and receiving a package in a secure location to prevent theft and damage of the package. The locking-mechanism of the package receptacle assembly may require a code to be unlocked, which may include a tracking-number of the package. Additionally, locking-mechanism may include short-range-radio-protocol (e.g., BLUETOOTH) capabilities such that the code may be entered without physical contact to the touch-screen or may be entered via a mobile application.

15 Claims, 5 Drawing Sheets

(56) References Cited

U.S. PATENT DOCUMENTS

| | | | | |
|---|---|---|---|---|
| 7,178,716 | B2 * | 2/2007 | Yong | A47G 29/1201 232/24 |
| 7,191,932 | B2 * | 3/2007 | Fobbe | A47G 29/141 232/19 |
| 7,246,738 | B2 | 7/2007 | Jonas | |
| 7,464,999 | B2 * | 12/2008 | Quinn | A47B 43/00 312/258 |
| 7,885,821 | B2 | 2/2011 | Tait | |
| 2001/0045449 | A1 * | 11/2001 | Shannon | A47G 29/141 232/19 |
| 2002/0162883 | A1 | 11/2002 | Arvonio | |
| 2004/0122780 | A1 | 6/2004 | Devar | |
| 2011/0115350 | A1 * | 5/2011 | Tsai | A47B 43/00 312/262 |
| 2014/0008246 | A1 | 1/2014 | Pfeiffer | |
| 2014/0014008 | A1 | 1/2014 | Tompkins | |

* cited by examiner

PACKAGE RECEPTACLE SYSTEMS

CROSS-REFERENCE TO RELATED APPLICATION

The present application is related to and claims priority from prior provisional application Ser. No. 62/191,676, filed Jul. 13, 2015 which application is incorporated herein by reference.

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of parcel delivery storage and more specifically relates to a package receptacle system.

2. Description of Related Art

Online shopping has become a popular way for individuals to purchase goods. Because of the prevalence, ease, and sometimes discount pricing of online shopping, more and more people are ordering products from far away locations which are shipped as packages or parcels. Package/parcel deliveries may generally come at any hour and during any type of weather conditions.

Often times, the person intended to receive the package may not be present during the time the package is delivered. A package which is delivered in the morning may be left unattended and vulnerable to theft and damage due to inclement weather. Moreover, some packages may not be delivered to an unattended location and a delivery must be attempted again and again, which increases the cost of deliveries in general for all consumers. This is not desirable.

Package lockers or securable/lockable mailboxes may be available for the delivery person to place the package into at select locations. However, such lockers may not be available in all locations, require the delivery person to carry a separate key for each locker, and still leaves the package vulnerable to damage in extreme heat, cold, and/or humidity. Therefore a suitable solution is desired.

Several attempts have been made to solve the above-mentioned problems such as those found in U.S. Pat. and Pub. Nos. 2014/0014008 to Tompkins; 2014/0008246 to Pfeiffer; 2002/0162883 to Arvonio et al.; 2004/0122780 to Devar; U.S. Pat. No. 7,885,821 to Tait; and U.S. Pat. No. 7,246,738 to Jonas. This art is representative of parcel delivery. However, none of the above inventions and patents, taken either singly or in combination, is seen to describe the invention as claimed.

Preferably, a package receptacle system should provide a secure location for a delivery person to deliver a package or parcel without the use of a separate key while protecting the package from inclement weather and theft and, yet would operate reliably and be manufactured at a modest expense. Thus, a need exists for a reliable package receptacle system to avoid the above-mentioned problems.

BRIEF SUMMARY OF THE INVENTION

In view of the foregoing disadvantages inherent in the known parcel delivery art, the present invention provides a novel package receptacle system. The general purpose of the present invention, which will be described subsequently in greater detail is to provide a secure box inside of which a delivered package may be placed which may include a motion sensor camera that notifies residents when a delivery is made which helps to prevent packages from being stolen, or damaged by the weather.

A package receptacle system is disclosed herein, in a preferred embodiment. The preferred embodiment comprising a package receptacle assembly. The package receptacle assembly may comprise a door-unit, a locking-mechanism, a top-unit, a rear-wall, a floor-unit, and two foldable-side-walls in functional and structural combination. The package receptacle assembly is structured and arranged to provide a user with a device useful for placing and/or receiving a package in a secure location to prevent theft and damage of the package. The user may include a delivery-person and/or a package-recipient.

The locking-mechanism of the package receptacle assembly may require a code to be unlocked, which may include a tracking-number of the package. Additionally, locking-mechanism may include short-range-radio-protocol (e.g., BLUETOOTH®) capabilities such that the code may be entered without physical contact to the touch-screen or may also be entered via a mobile application.

The door-unit may comprise a door-frame, two-doors, and two-hinges in functional and structural combination, and the locking-mechanism may comprise a lock and a touch-screen-device in functional combination and may also include a handle useful for aiding the delivery-person and/or the package-recipient in opening the door-assembly. The foldable-side-walls may each comprise (at least) one of each of two-panels and a wall-hinge in functional and structural combination such that each of the two foldable-side-walls are compressible to be more easily transported, stored, and installed. Each of the two-foldable-walls are preferably hingeldy attached to the door-unit and the rear-wall to form a complete unit.

In the preferred embodiment, the floor-unit is hingeldy attached to the door-unit such that the floor-unit may be rotated upward (and therefore inward) to provide for a more compact package receptacle assembly useful for storage and transport. Preferably, the top-unit is magnetically attached to each of the two-foldable-walls, the door-unit, and the rear-wall; useful for enclosing a defined area to provide a secure enclosure and such that the package receptacle system is substantially foldable and compressible as a complete unit.

Preferably, the package receptacle assembly further includes a motion-sensor in order to notify the package-recipient when the delivery-person has placed a package into the package receptacle assembly. Similarly, the package receptacle assembly may further include a wireless-camera to provide visual confirmation to the package-recipient.

In the preferred embodiment the door-unit, the top-unit, the two foldable-side-walls, and the rear-wall are structured and arranged to accept an-external-skin-wrap to provide customization and improved aesthetics to the package receptacle assembly as a whole. The package receptacle assembly is preferably weather-proof, constructed of flame-resistant materials, and fire-resistant to prevent damage to a package contained therein during a fire or in an event of adverse weather conditions.

Also disclosed herein, the kit preferably including: a package receptacle assembly and a set of user instructions. A method of use for a package receptacle system is also disclosed, preferably including the steps of: providing a package receptacle assembly, unlocking the package receptacle assembly, opening the door-unit, placing a package within the package receptacle assembly, closing the door-unit, and locking the door-unit. Additional steps may include: unlocking the door-unit, opening the door-unit, removing the package from the package receptacle assembly, and closing said door-unit.

The present invention holds significant improvements and serves as a package receptacle system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, package receptacle system, constructed and operative according to the teachings of the present invention.

The various embodiments of the present invention will hereinafter be described in conjunction with the appended drawings, wherein like designations denote like elements.

DETAILED DESCRIPTION

Figure 1:
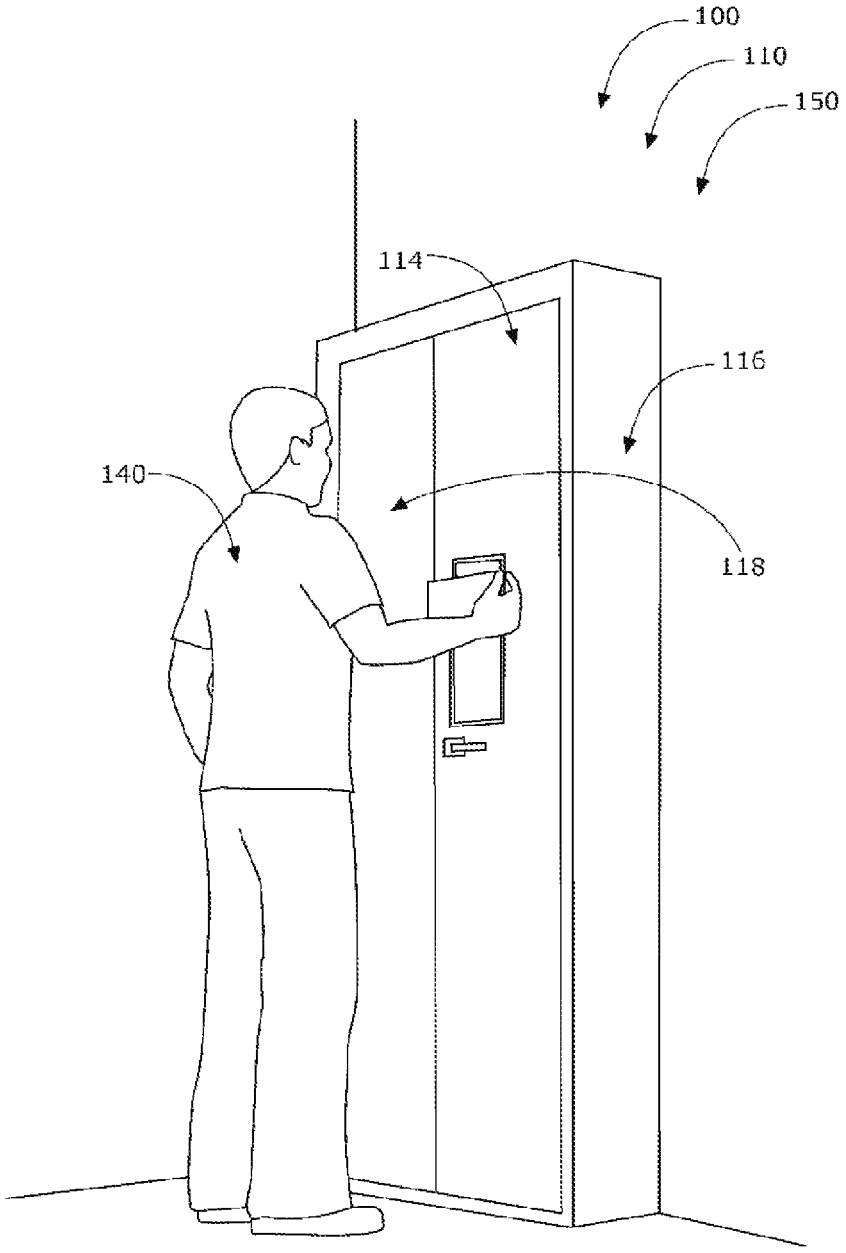
FIG. 1 shows a perspective view illustrating a package receptacle system during an 'in-use' condition showing user unlocking the locking-mechanism of the package receptacle system according to an embodiment of the present invention.
Figure 2:
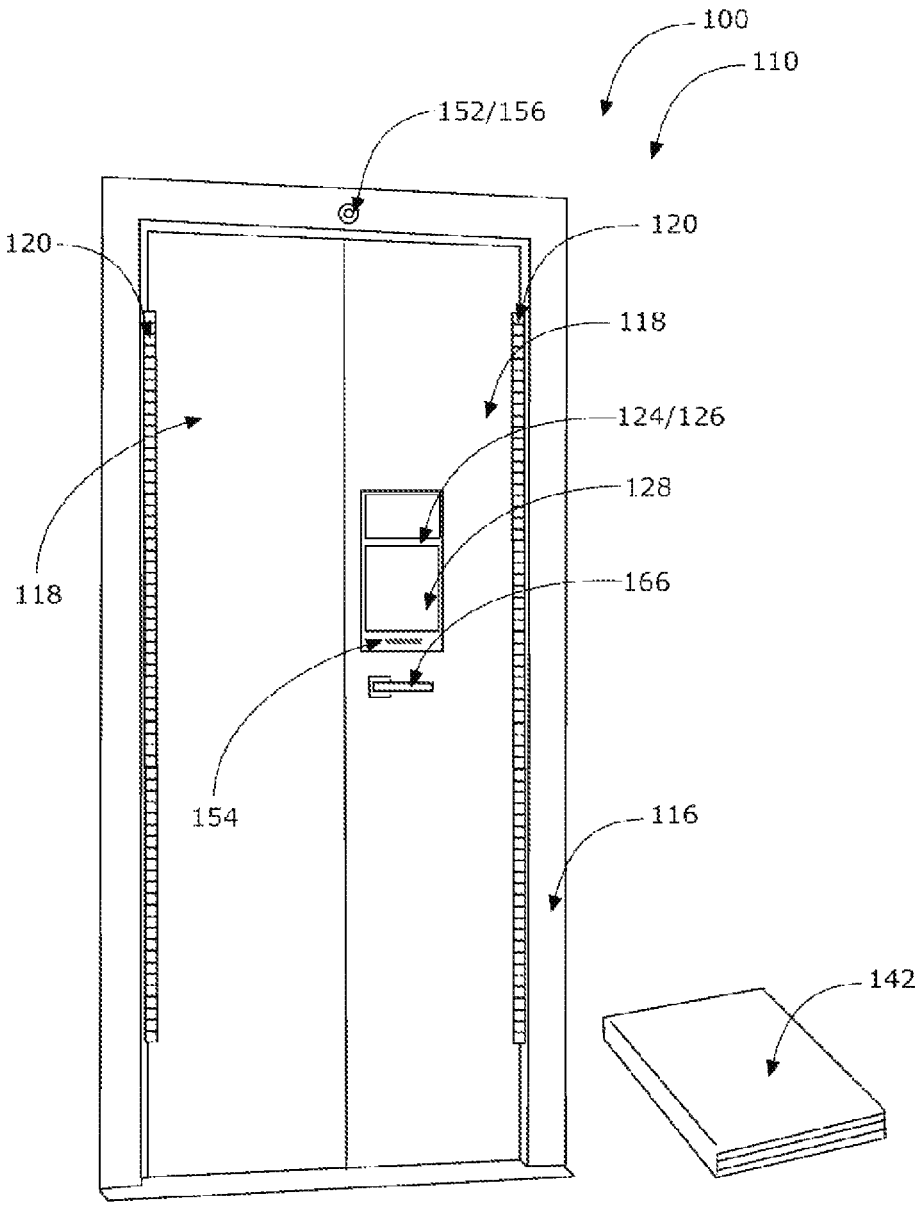
FIG. 2 is a perspective view illustrating the package receptacle assembly of the package receptacle system comprising a frame-assembly, a door-assembly, locking-mechanism, and wall-unit according to an embodiment of the present invention of FIG. 1.
Figure 3:
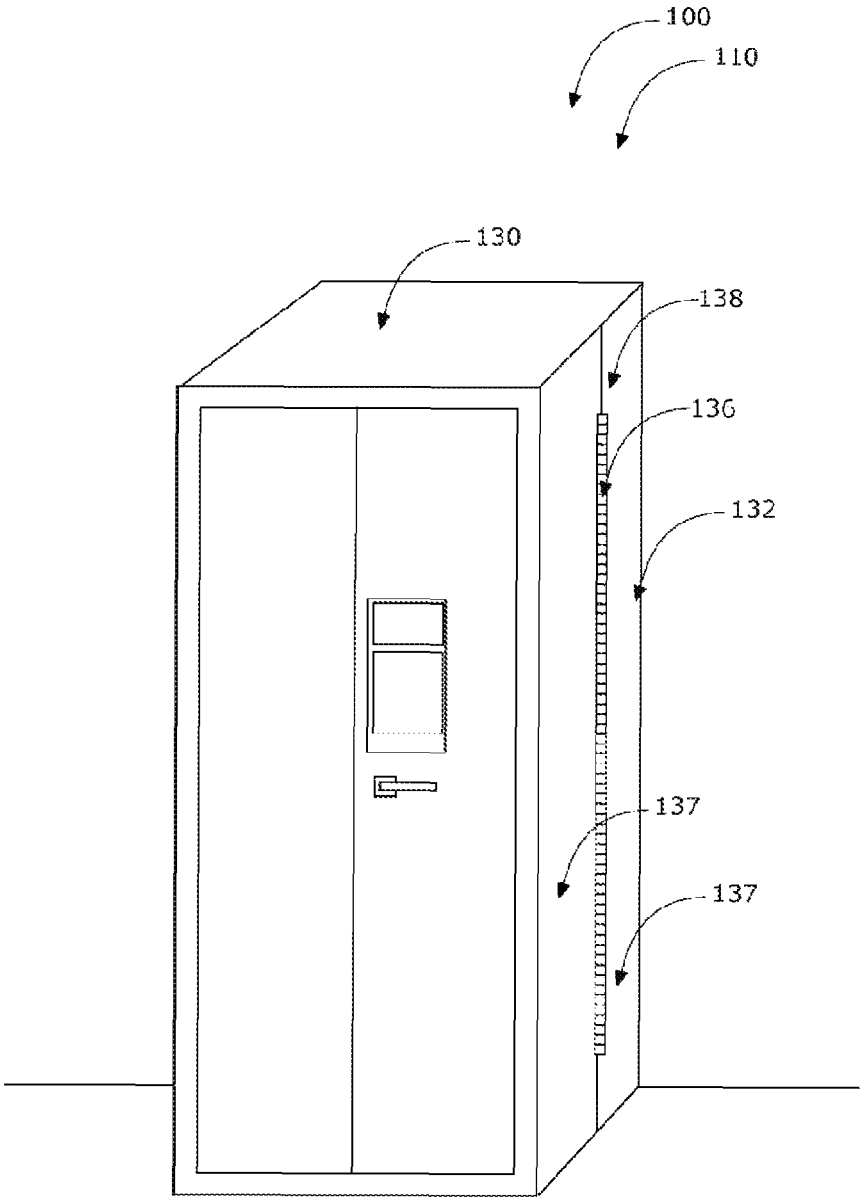
FIG. 3 is a perspective view illustrating the rear-face of the door-assembly of the package receptacle assembly according to an embodiment of the present invention of FIGS. 1-2.
Figure 4:
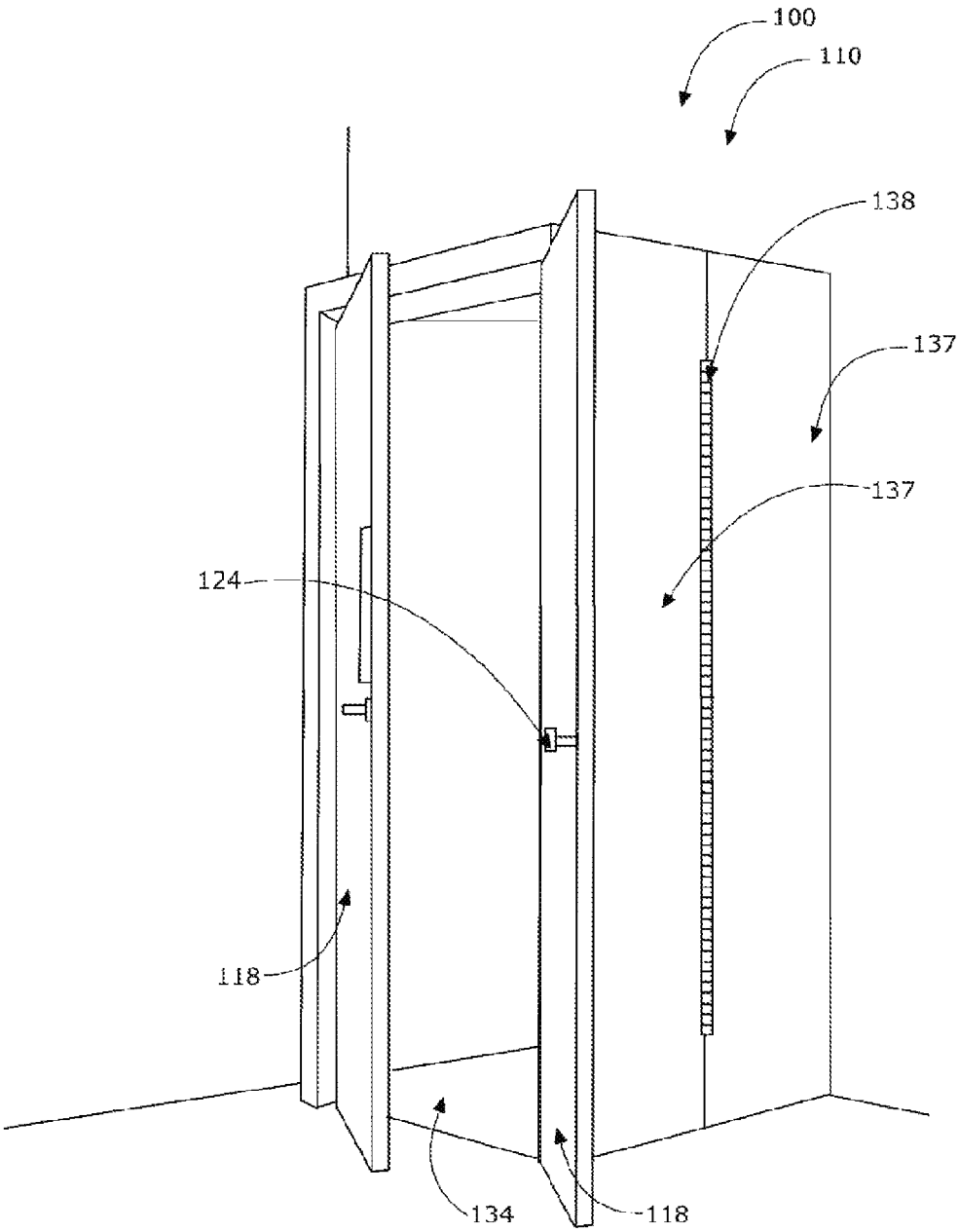
FIG. 4 is a perspective view illustrating a wall-unit comprising a flat-surface and a cavity according to an embodiment of the present invention of FIGS. 1-3.

As discussed above, embodiments of the present invention relate to a parcel delivery system and more particularly to a package receptacle system as used to improve the security of delivering a package or parcel providing a secure location for a delivery person to place a package/parcel.

Generally speaking, a package receptacle system comprises a package receptacle assembly; with the package receptacle assembly comprising a door-unit, a locking-mechanism, a top-unit, a rear-wall, a floor-unit, and two foldable-side-walls.

Referring to the drawings by numerals of reference there is shown in FIGS. 1-4, package receptacle system 100 comprising package receptacle assembly 110. Package receptacle assembly 110 may comprise door-unit 114, locking-mechanism 124, top-unit 130, rear-wall 132, floor-unit 134, and two foldable-side-walls 136 in functional and structural combination. Locking-mechanism 124 may be selectively securable to door-unit 114 and door-unit 114 may comprise handle 166 useful for aiding user 140 (a package-recipient and/or a delivery-person) in opening door-assembly 110. Package receptacle assembly 110 is structured and arranged to provide user 140 with a device useful for placing and receiving a package in a secure location to prevent theft and damage of the package.

Relationally speaking, each foldable-side-wall 136 may comprise at least two-panels 137 and wall-hinge 138 in functional and structural combination such that each of two foldable-side-walls 136 are compressible and two-foldable-walls 136 may be hingeldy attached to door-unit 114 and rear-wall 132. Floor-unit 134 may be hingeldy attached to door-unit 114 such that floor-unit 134 may be rotated (updwardly or downwardly, depending upon the specific application and user preferences) to provide a more compact package receptacle assembly 110 for ease of transport and/or storage.

Package receptacle assembly 110 may further comprise motion-sensor 152 to notify a package-recipient when a delivery-person has placed a package or other article into package receptacle assembly 110, and locking-mechanism 124 may require a code to be unlocked. Package receptacle assembly 110 may further include a wireless-camera 156 to provide visual confirmation and additional security to package receptacle system 100 and include touch-screen-device 128 for entry of the code.

Locking-mechanism 124 may include short-range-radio-protocol capabilities such that the code may be entered without physical contact to touch-screen-device 128. Similarly, code may be entered via a mobile application and the code may include a tracking-number of the package. Locking-mechanism 124 may comprise key-card-slot 154 such that locking-mechanism is unlockable via a key-card and locking-mechanism may additionally include fingerprint reading capabilities. Additionally, package receptacle system 100 may include a barcode-scanner (including two-dimensional and matrix-barcodes) such that the barcode-scanner may be used to unlock locking-mechanism 124.

Top-unit 130 may be magnetically attached to each of two-foldable-walls 136, door-unit 114, and rear-wall 132 useful for enclosing a defined area to provide a secure enclosure such that package receptacle system 100 is substantially foldable and compressible.

Door-unit 114 may comprise door-frame 116, two-doors 118, and two-hinges 120 in functional and structural combination; locking-mechanism 124 may comprise lock 126 and touch-screen-device 128 in functional combination. Door-unit 114, top-unit 130, two foldable-side-walls 136, and rear-wall 132 may be structured and arranged to accept an-external-skin-wrap for aesthetics and additional protection.

Package receptacle assembly 110 may be weather-proof in some embodiments. Additionally package receptacle assembly 110 may constructed of flame-resistant materials to avoid fire, and may also be fire-resistant to prevent damage to a package contained therein during a fire.

Package receptacle system 100 may be sold as a kit comprising the following parts: at least one package receptacle assembly 110 (comprising door-unit 114, locking-mechanism 124, top-unit 130, rear-wall 132, and floor-unit 134, and two foldable-side-walls 136) and at least one set of user instructions 142. The kit has instructions such that functional relationships are detailed in relation to the structure of the invention (such that the invention can be used, maintained, or the like in a preferred manner). Package receptacle system 100 may be manufactured and provided for sale in a wide variety of sizes and shapes for a wide assortment of applications.

Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different installation means and combinations, parts may be sold separately, etc., may be sufficient.

Figure 5:
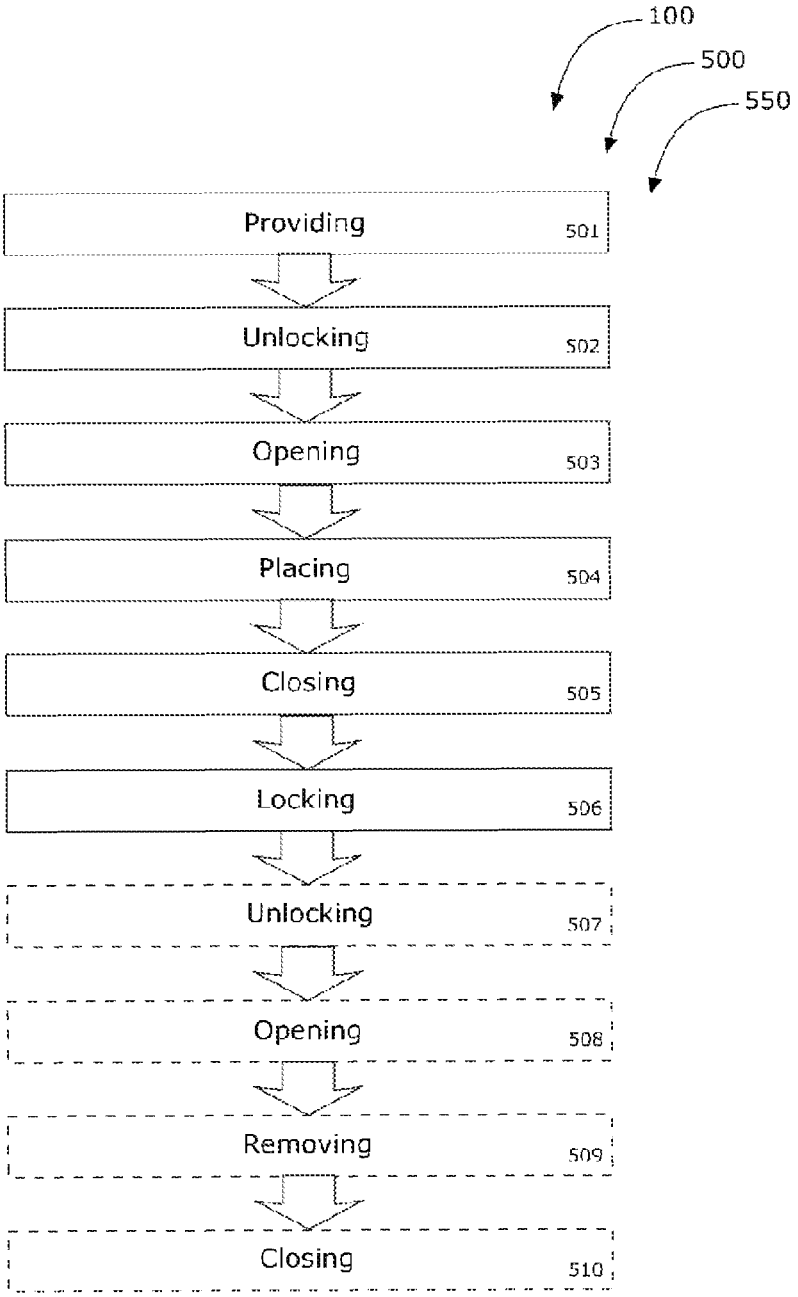
FIG. 5 is a flowchart illustrating a method of use for a package receptacle system according to an embodiment of the present invention of FIGS. 1-4.

Referring now to FIG. 5 showing flowchart 550 illustrating method of use 500 for package receptacle system 100 according to an embodiment of the present invention of FIGS. 1-4. As shown, method of use 500 may comprise the steps of: step one 501, providing package receptacle assembly 110; step two, 502 unlocking package receptacle assembly 110; step three 503 opening door-unit 114; step four 504 placing a package within package receptacle assembly 110; step five 505 closing door-unit 114; step six 506 locking door-unit 114; step seven 507 unlocking door-unit 114; step eight 508 opening door-unit 114; step nine 509 removing the package from package receptacle assembly 110; and step ten 510 closing door-unit 114.

It should be noted that steps seven through ten (507, 508, 509, and 510) are optional steps and may not be implemented in all cases. Optional steps of method of use 500 are illustrated using dotted lines in FIG. 5 so as to distinguish them from the other steps of method of use 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A package receptacle system comprising:
a package receptacle assembly comprising;
a door-unit comprising;
a door-frame;
two-doors; and
two-hinges;
a locking-mechanism comprising;
a lock; and
a touch-screen-device;
a top-unit;
a rear-wall; and
a floor-unit; and
two foldable-side-walls comprising;
two-panels; and
a wall-hinge;
wherein said two foldable-side-walls each comprise at least one of each of said two-panels and said wall-hinge in functional and structural combination such that each of said two foldable-side-walls are compressible;
wherein each of said two-foldable-walls are hingedly attached to said door-unit and said rear-wall;
wherein said floor-unit is hingedly attached to said door-unit such that said floor-unit is rotatable to provide for a more compact package receptacle assembly;
wherein said top-unit is magnetically attached to each of said two-foldable-walls, said door-unit, and said rear-wall useful for enclosing a defined area to provide a secure enclosure and said package receptacle system is substantially foldable and compressible; and
wherein said package receptacle assembly is structured and arranged to provide a user with a device useful for placing and receiving a package in a secure location to prevent theft and damage of said package.

2. The package receptacle system of claim 1 wherein said package receptacle assembly further comprises a motion-sensor to notify said recipient when said delivery-person has placed said package into said package receptacle assembly.

3. The package receptacle system of claim 1 wherein said locking-mechanism requires a code to be unlocked.

4. The package receptacle system of claim 3 wherein said locking-mechanism includes short-range-radio-protocol capabilities such that said code may be entered without physical contact to said touch-screen.

5. The package receptacle system of claim 3 wherein said code comprises a tracking-number of said package.

6. The package receptacle system of claim 3 wherein said code is entered via a mobile application.

7. The package receptacle system of claim 1 wherein said locking-mechanism further is selectively securable to said door-unit.

8. The package receptacle system of claim 1 wherein said door-unit further comprises a handle useful for aiding said user and said recipient in opening said door-assembly.

9. The package receptacle system of claim 1 wherein said locking-mechanism comprises a key-card-slot such that said locking-mechanism is unlockable via a key-card.

10. The package receptacle system of claim 1 wherein said locking-mechanism includes fingerprint reading capabilities.

11. The package receptacle system of claim 1 further comprising a barcode-scanner such that said barcode-scanner may be used to unlock said locking-mechanism.

12. The package receptacle system of claim 1 wherein said door-unit, said a top-unit, said two foldable-side-walls, and said a rear-wall are structured and arranged to accept an-external-skin-wrap.

13. The package receptacle system of claim 1 wherein said package receptacle assembly further includes a wireless-camera.

14. The package receptacle system of claim 1 wherein said package receptacle assembly is weather-proof.

15. The package receptacle system of claim 1 wherein said package receptacle assembly is constructed of flame-resistant materials.

* * * * *